US005491921A

United States Patent [19]

Allen

[11] Patent Number: 5,491,921

[45] Date of Patent: Feb. 20, 1996

[54] PIVOTING SHOOTING STAND

[76] Inventor: J. B. Allen, P.O. Box 366, Alexandria, Tenn. 37012

[21] Appl. No.: 346,468

[22] Filed: Nov. 29, 1994

[51] Int. Cl.[6] ..... F41A 23/00

[52] U.S. Cl. ..... 42/94

[58] Field of Search ..... 42/94; 89/37.03, 89/37.04, 37.16, 37.17, 37.13

[56] References Cited

U.S. PATENT DOCUMENTS

| | | | |
|---|---|---|---|
| 2,444,246 | 6/1948 | Chase et al. | 89/37.13 |
| 2,811,977 | 11/1957 | McClish | 135/87 |
| 3,913,598 | 10/1975 | Glutting, Jr. et al. | 135/87 |
| 4,083,601 | 4/1978 | McBeth | 297/184 |
| 4,449,034 | 5/1984 | Taniguchi | 219/217 |
| 4,937,965 | 7/1990 | Narvaez | 42/94 |
| 5,060,410 | 10/1991 | Mueller | 42/94 |
| 5,220,116 | 6/1993 | Sheets | 42/94 |
| 5,271,175 | 12/1993 | West, III | 42/94 |
| 5,377,711 | 1/1995 | Mueller | 135/87 |

OTHER PUBLICATIONS

Photograph—Shooting bench by Wallace Barnhill–Varmint Hunter.

Photograph–Rotobench by Accuright–Varmint Hunter.

Photograph—Shooting bench by Tom Foster–Varmint Hunter.

*Primary Examiner*—Charles T. Jordan
*Assistant Examiner*—Christopher K. Montgomery
*Attorney, Agent, or Firm*—Waddey & Patterson; Mark J. Patterson

[57] ABSTRACT

A portable shooting stand is disclosed in which a modular seat and table assembly rides in a circular fashion on rollers over the top of a ground engaging roller track.

10 Claims, 7 Drawing Sheets

PIVOTING SHOOTING STAND

BACKGROUND OF THE INVENTION

The present invention relates generally to seats and stands used by sportsmen while hunting in the outdoors, and more particularly to portable shooting and rifle stands capable of being quickly moved, adjusted, or pivoted to a variety of shooting positions.

The hunting of game using a rifle or other weapon can often require a great deal of patience on the part of the hunter, whether in an open field or in a wooded area. In particular, hunters often have to remain in a fixed location for an extended period of time in order to place themselves where game will enter or move into the shooting range of the hunter. For this reason, many hunters use crude or complex seats and shooting stands to allow them to comfortably maintain a seated position yet still respond quickly when the hunted prey enters the proximity.

When hunting some animals, prairie dogs being one example, it is also important that the hunter visually survey across a wide lateral field of view, looking for the sudden appearance of a target in the field. When the animal is spotted, the hunter then must rapidly change position to place his body and rifle into an adequate shooting position with respect to the visualized target. Unfortunately, prior art shootings seats and stands have not allowed this rapid change of horizontal or lateral position. Rather, prior art shooting stands would require the hunter to either contort his body into an awkward shooting position or to physically move the entire stand, causing both delays and unnecessary noise which might disturb the game.

Those prior art shooting stands which are to some extent adjustable, suffer from the further deficiency of lacking adequate ground engaging support. As a result, a sudden change in position may result in an off-centered tilting or unbalancing of the stand, causing a lack of stability during the shot.

What is needed, then, is a portable shooting stand which allows the hunter to remain in a seated position for an extended period of time, yet facilitate rapid and stable lateral or horizontal adjustment in shooting position when the target is spotted. Such a device is presently lacking in the prior art.

SUMMARY OF THE INVENTION

An object of the present invention is to provide a shooting stand for use by hunters in the field which can be quickly pivoted to different shooting positions.

Another object of the present invention is to provide a pivoting shooting stand that is portable and easy to assemble and disassemble.

A further object of the invention is to adapt a shooting stand having an outer covering for use where rapid change in shooting position is required.

In accordance with these and other objects which will be apparent to those skilled in the art, a shooting stand is described which has a seat and table assembly combined with a separable roller track. A plurality of legs support the seat a comfortable distance above the ground and a table above the seat. The top of each leg is connected to the bottom surface of the table. The lower ends of the legs are joined together and laterally stabilized by front and rear reinforcing members. At the bottom end of each leg is a roller assembly which includes a two piece roller forming a concave roller track engaging surface. The rollers rest on and roll in circular fashion around the roller track, allowing the user to quickly pivot the shooting stand a full three hundred sixty degrees (360°).

DESCRIPTION OF THE PREFERRED EMBODIMENT

Figure 1:
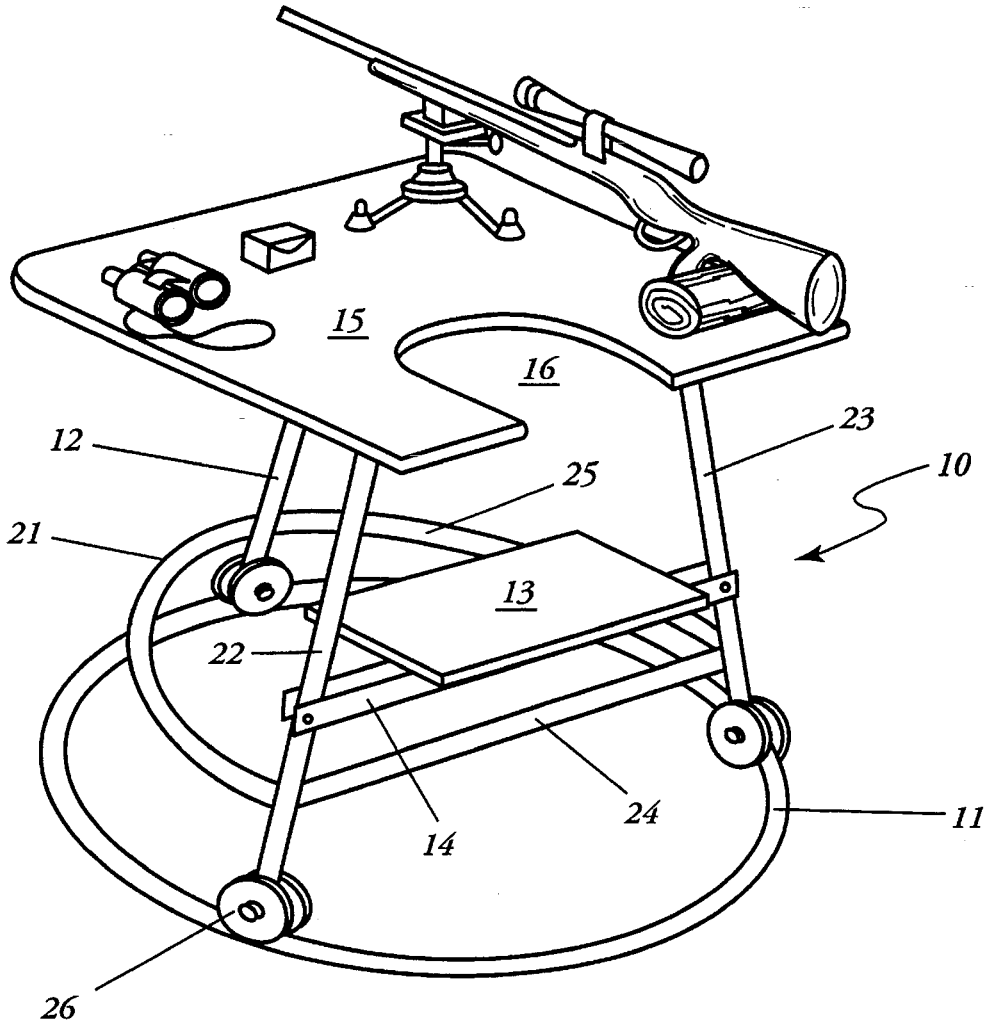
FIG. 1 is an oblique view of the pivoting shooting stand of the present invention.
Figure 2:
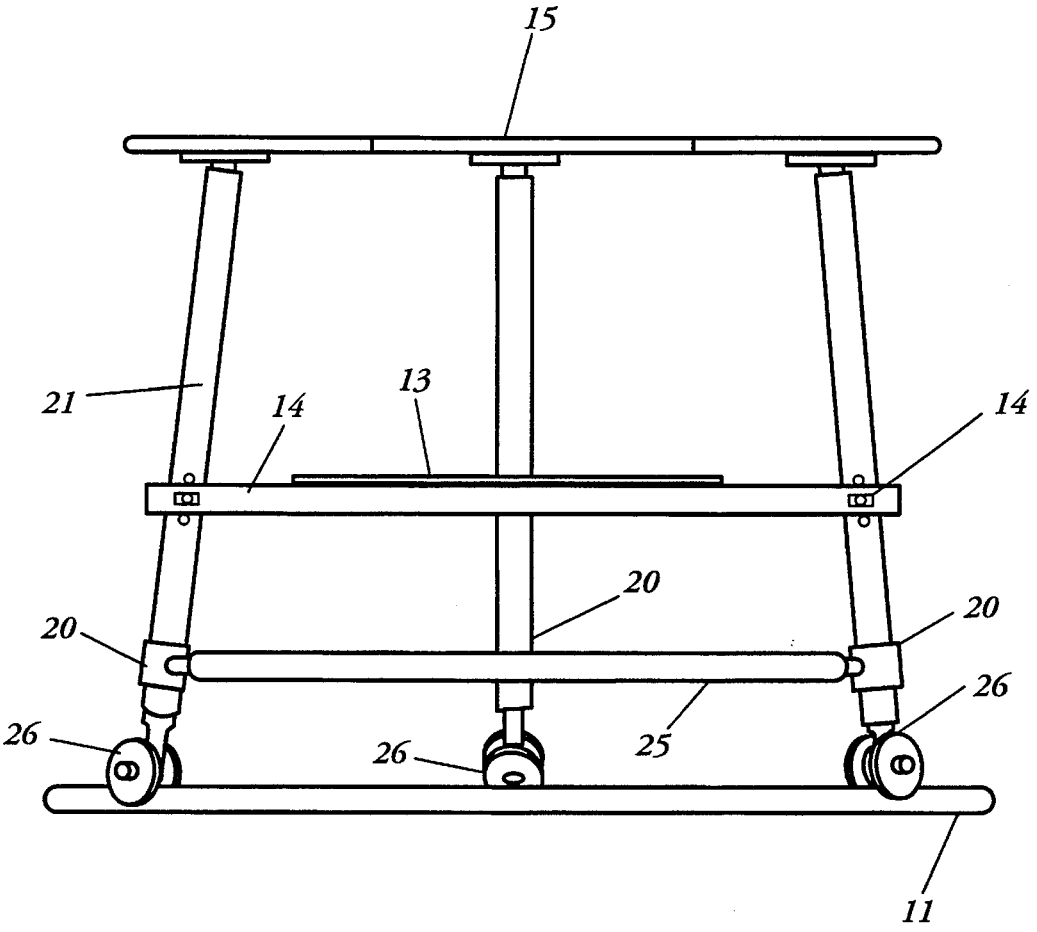
FIG. 2 is a rear view of the pivoting shooting stand of the present invention.
Figure 3:
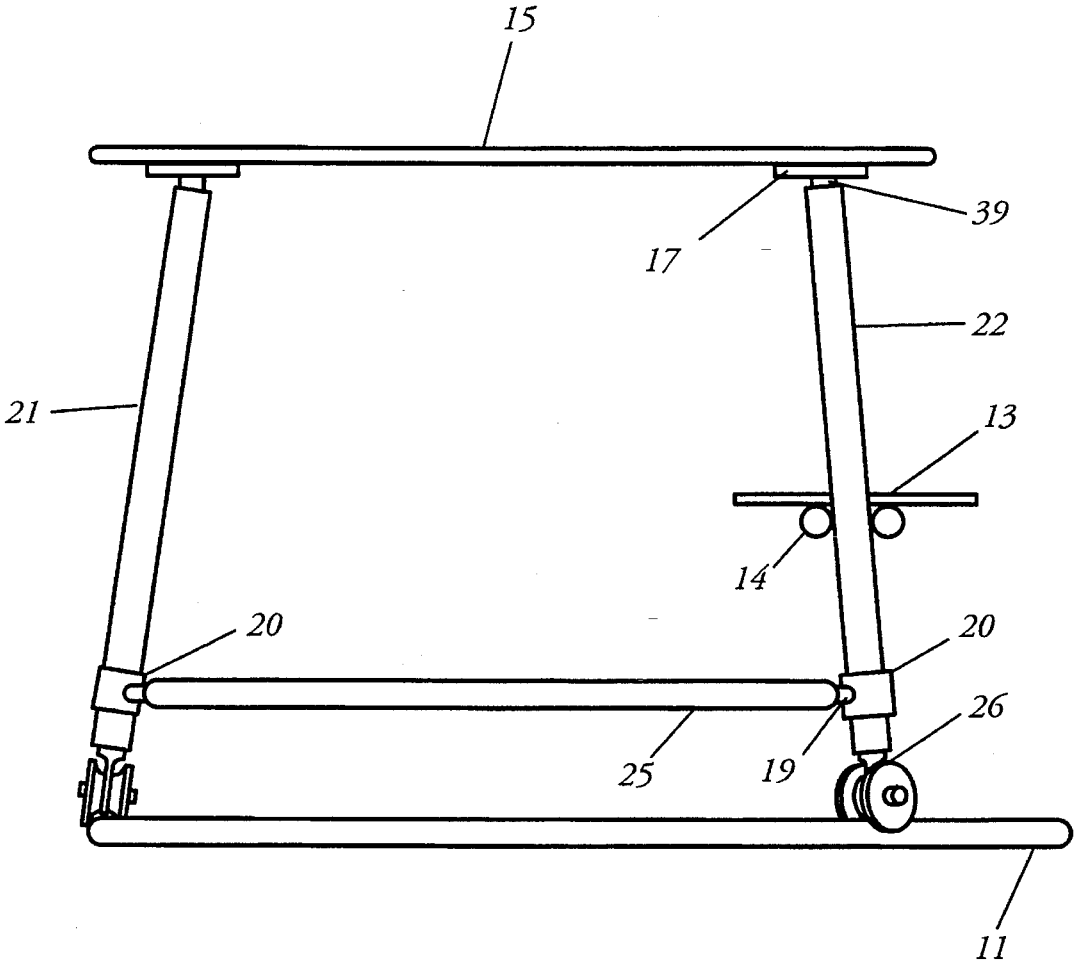
FIG. 3 is a left side view of the pivoting shooting stand of the present invention.

Looking first at FIGS. 1, 2, and 3, the pivoting shooting stand of the present invention is shown generally at 10. Stand 10 generally includes two separable assemblies, a seat and table assembly 12, and a base which, in a preferred embodiment, is a roller track 11. Roller track 11 rests on a ground surface (not shown) to provide stability for seat and table assembly 12. Roller assemblies 26, a plurality of which are attached to seat and table assembly 12, engage the upward facing surface of roller track 11 to provide a means to pivot seat and table assembly 12 with respect to roller track 11 and the ground surface.

In a preferred embodiment of the invention, seat and table assembly 12 includes a table 15 and seat 13 joined together to form an assembly 12 which can pivot together as a single unit. To allow the user to sit comfortably above the ground and rest his rifle and arms on a flat, stable surface, stand 10 must also have means to support seat 13 above the ground and table 15 above seat 13. Accordingly, the top ends of first, second, and third support legs 21, 22, and 23 are attached to the lower surface of table 15 and extend downward a sufficient distance to raise table 15 above the ground surface so that a seated user of stand 10 can be in a comfortable shooting position. Support legs 21, 22, 23 are preferably cylindrical or tubular structures made of aluminum or other lightweight metal. To provide stability and rigidity at the lower ends of legs 21, 22, and 23, they are joined together by a rear reinforcing member 24 and a front reinforcing member 25, as best seen on FIG. 1. Front reinforcing member 25 is preferably a lightweight metal tube bent to form an approximate semi-circular shape, divided at its mid-point by front support leg 21. Rear reinforcement member 24 joins second and third support legs 22 and 23.

As best seen on FIGS. 2 and 3, rear and front reinforcing members 24 and 25 are attached to corresponding first, second, and third support legs 21, 22, and 23 by joint connectors 20. Accordingly, rear and front reinforcing members 24 and 25 preferably have hollow ends so that a laterally protruding stub portion 19 of joint connector 20 can extend within reinforcement members 24 and 25, thereby holding them in place.

Figure 6:
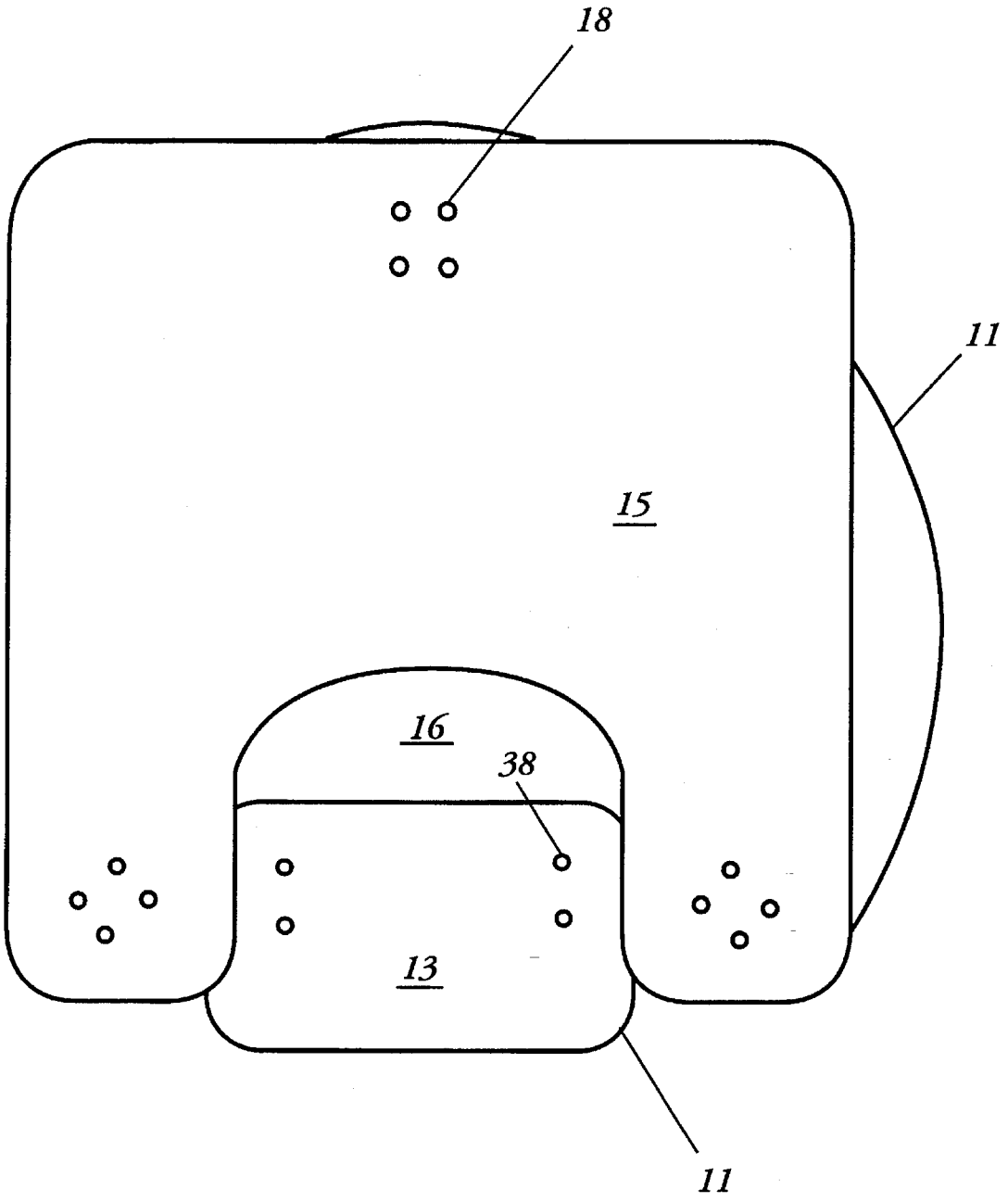
FIG. 6 is a top view of the pivoting shooting stand of the present invention.

To allow the user of stand 10 to remain in a comfortable position over an extended period of time, seat 13 is attached to and between central portions of left and right support legs 22 and 23. As best seen on FIG. 3, the lower surface of seat 13 rests on two seat support rails 14, one of which is bolted in a conventional fashion to the inner surface of left and right support legs 22 and 23 and a second of which is mounted to the outer facing surface of support legs 22 and 23. As seen in FIG. 6, seat 13 is secured to the upward facing surfaces of seat support rails 14 by screw or other conventional fastener inserted through seat attachment holes 38.

Figure 4:
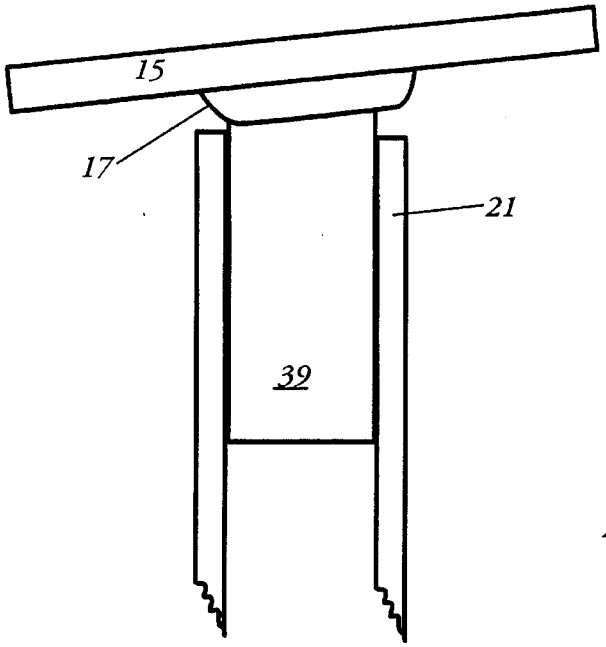
FIG. 4 is an enlarged view of detail section B of FIG. 3.

Table 15 is preferably oriented horizontally such that it is substantially parallel to the ground and the horizontal plane of roller track 11. An opening 16 is created in the rearward facing portion of table 15 so that the user's torso can extend through opening 16, thus providing close in support for the user's elbows, arms, weapon, and other accessories. As best seen in FIGS. 3 and 4, the lower surface of table 15 is provided with three leg mounting flanges 17. A cylindrical leg engagement member 39 extends downwardly at a slight outward angle with respect to table 15 from each flange 17. Leg engagement members 39 will preferably have an outside diameter corresponding to the inside diameter of each of legs 21, 22, and 23, providing a frictional fit whereby table 15 can be easily removed from legs 21, 22, and 23 for disassembly and traveling. In a preferred embodiment of the invention, to provide additional stability of stand 10, the angle of leg engagement members 39 with respect to table 15 is approximately seven degrees (7°). As shown on FIG. 6, leg mounting flanges 17 are attached to table 15 by screw or other fastener disposed through leg attachment holes 18.

Figure 5:
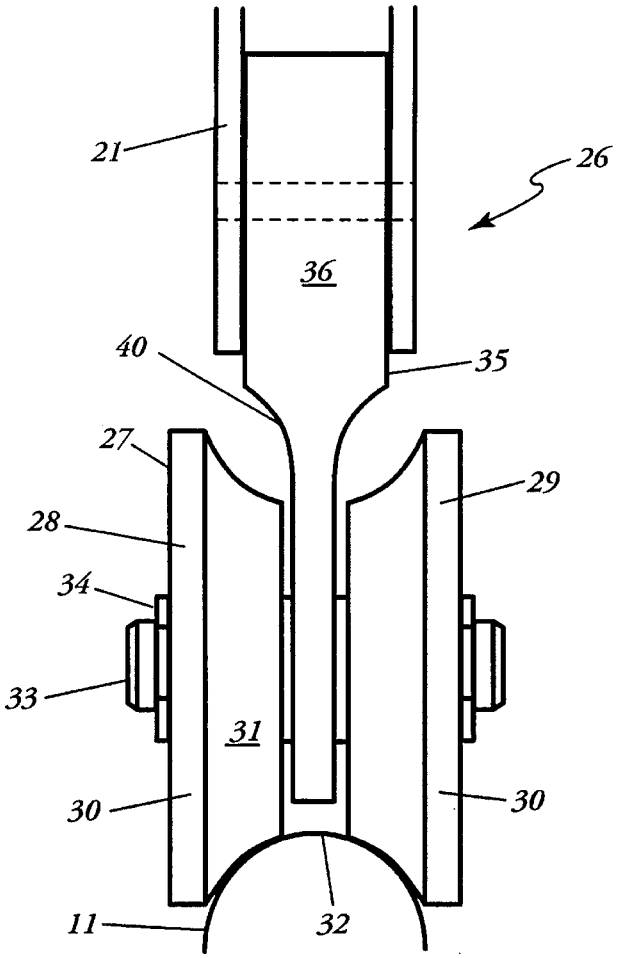
FIG. 5 is an enlarged view of detail section A of FIG. 3.

Additional detail describing a preferred embodiment of roller assembly 26 is illustrated in FIG. 5. Each roller assembly 26 will include a roller 27 having left and right roller pieces 28 and 29. Each roller piece 28 and 29 will have an outer segment 30 and a chamfered inner segment 31 such that the aligned combination of left and right roller pieces 28 and 29 will define a roller track engaging surface 32 having an approximate semicircular concave shape. Track engaging surface 32 will preferably conform to the shape of the upper surface of roller track 11 such that each roller 27 can engage track 11 in a rotating fashion while resisting lateral movement of roller 27 off the track to either the inside or outside.

Each roller 27 is rotatably attached through a lower section 37 of roller mount 35 by an axle pin 33. Retainer tings 34 engage a beveled portion (not shown) of axle pin 33 thereby retaining left and right roller pieces 28 and 29 in an aligned position with respect to each other. An upper cylindrical section 36 of roller mount 35 frictionally fits within the inner diameter of the bottom end of each of legs 21, 22, and 23, thereby allowing each roller assembly 26 to be easily removed for disassembly. Lower section 37 makes a transition into upper cylindrical section 36 of roller mount 35 at arcuate portion 40.

Having described the structure of the pivoting shooting stand of the present invention, it will now be apparent to those skilled in the art that the user of stand 10 can position himself or herself in a seated position on seat 13, resting the arms and weapon of the user on table 15. The legs of the user can rest either on front reinforcing member 25 or, preferably, on the ground surface. When an animal of the type being hunted is visualized by the user, the user can simply pivot the entire seat and table assembly 12 of stand 10 rapidly around roller track 11 to stop assembly 12 at the preferred orientation, and then begin shooting.

To maximize the convenience of stand 10, each of legs 21, 22, and 23 can, in fact, be made in two parts with corresponding adjustment holes so that the height of table 15 and seat 13 above the ground is adjustable to the needs of the user. Similarly, second and third support legs 22 and 23 can be provided with multiple mounting holes for attachment of seat support rails 14 thereby allowing for vertical adjustment of seat 13 independent of table 15 to meet the needs of the user as well. Further, the design of stand 10 as shown allows for rapid assembly and disassembly of stand 10 for traveling purposes.

Although the preferred embodiment as described herein suggests a mounting of both table 15 and seat 13 to support legs 21, 22, and 23, to form a unitary seat and table assembly 12, seat 13 can also be mounted such that an additional support leg with attached roller assembly extends downwardly from seat 13 to roller track 11. Alternatively, table 15 can be circular in shape and attached in a fixed position centrally disposed with respect to roller track 11 whereby only seat 13 will pivot, rotating the user around table 15 in a circular fashion.

Also, although FIGS. 4 and 5 illustrate a base defined by a cylindrical roller track 11, with a concave corresponding roller assembly track engaging surface 32, the base could alternatively be provided with an inner rail system whereby the roller assembly will run within a slot in the base.

Figure 7:
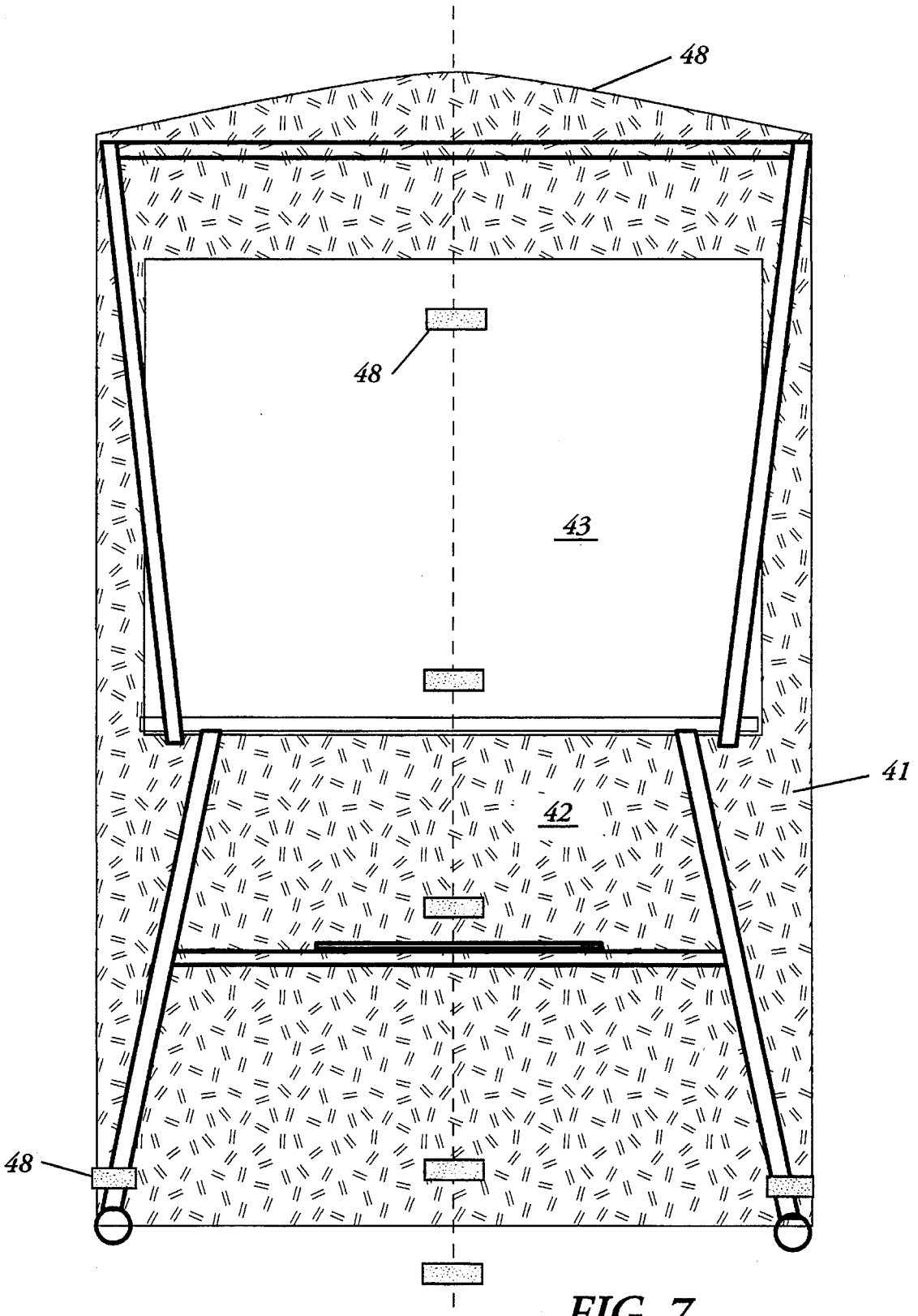
FIG. 7 is a rear view of a second embodiment of the shooting stand equipped with an outer camouflage covering and supporting frame.
Figure 8:
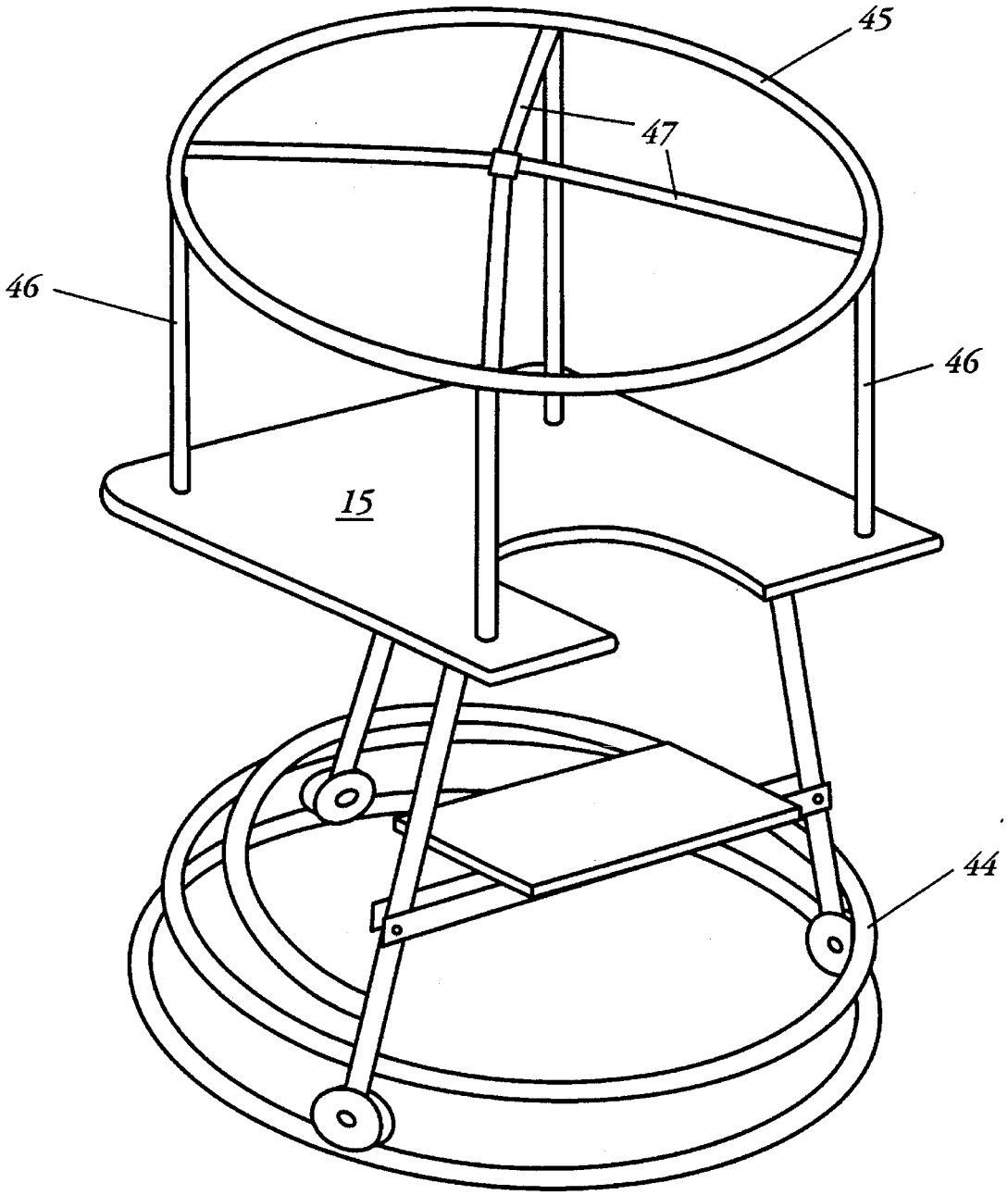
FIG. 8 is a perspective view of the shooting stand embodiment of FIG. 7 with the outer covering removed to show the supporting frame.

FIGS. 7 and 8 illustrate a second embodiment of the shooting stand which includes an outer covering 41, the purpose of which is to conceal the shooter. Accordingly, covering 41 will preferably include appropriate tree bark camouflage material 42 surrounding a camouflage colored nylon mesh section 43 for ventilation.

Cover mounting means are additionally provided in this embodiment, including a lower mounting ting 44 (FIG. 8) which is attached to support legs 21, 22, and 23, and an upper ring 45 which is positioned above table 15 by four vertical support members 46 spaced around the periphery of and removable attached to table 15. The top portion 48 of cover 41 assumes a dome shape as it conforms to and rests on curved upper cover frame members 47. Preferably, top portion 48 of cover 41 will be coated with polyurethane 52 or other suitable water resistant material. Also, each of support members 46, lower and upper support rings 44 and 45, and frame members 47 will comprise friction fit interconnecting tubular sections, as described above for roller track 11, support member 25, and support legs 21, 22, and 23 to allow easy disassembly.

Cover 41 is loosely secured to stand 10 by placing it over upper frame members 47. The sections of upper mounting ting 45 are assembled while sliding them within pockets (not shown) sewn into the inside surface of cover 41. The lower margin of cover 41 is draped over lower mounting ring 44 with the sections of lower mounting ting placed within pockets sewn inside cover 41. The rear edges of cover 41 are attached using hook and loop fastener straps 50.

Thus, although there have been described particular embodiments of the present invention of a new and useful pivoting shooting stand, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. A shooting stand comprising:

a. a seat and table assembly, said assembly including a table, a seat, seat support means to support said seat above a ground surface, and table support means to support said table above said seat;

b. a base disposed between said seat and table assembly and the ground surface; and c. pivot means attached between said seat and table assembly and said base to allow a user of said stand to pivot said seat with respect to the ground surface; wherein said pivot means comprises d. a roller track; and e. roller assembly attached to said table support means.

2. A shooting stand comprising a. a seat and table assembly, said assembly including a table, a seat, seat support means to support said seat above a ground surface, and table support means to support said table above said seat;

b. a base disposed between said seat and table assembly and the ground surface;

c. pivot means attached between said seat and table assembly and said base to allow a user of said stand to pivot said seat with respect to the ground surface;

d. said base comprising a roller track;

e. said pivot means comprising at least one roller assembly having a surface for rotatably engaging said roller track; and f. said table support means comprising a plurality of support legs and wherein said roller assembly is attached to said support legs.

3. A shooting stand comprising:

a. a table;

b. table support means to support said table above a ground surface;

c. a seat attached to said table support means;

d. a base;

e. pivot means attached to said table support means to allow a user of said stand to pivot said table, said seat, and said table support means as a unit with respect to said base comprising rollers; and f. said base comprising a circular rail and each of said rollers having a surface to rotatably engage said rail.

4. The shooting stand of claim 3, said table support means comprising first, second, and third support legs attached to a lower surface of said table, said seat attached to said second and third support legs.

5. The shooting stand of claim 4, said pivot means attached to each of said first, second, and third support legs.

6. The shooting stand of either of claims 1 or 3 further comprising a camouflage cover and means attached to said stand for supporting said cover above and around a user of said stand.

7. A shooting stand comprising:

a. a table;

b. table support means to support said table above a ground surface;

c. a seat attached to said table support means;

d. a base;

e. pivot means attached to said table support means to allow a user of said stand to pivot said table, said seat, and said table support means as a unit with respect to said base;

f. said table support means comprising first, second, and third support legs attached to a lower surface of said table, said seat attached to said second and third support legs;

g. said pivot means comprising rollers attached to each of said first, second, and third support legs; and h. said base comprising a circular rail and each of said rollers having a surface to rotatably engage said rail.

8. The shooting stand of claim 7, said rail having a curved upper surface and said roller surface being formed to conform to and removably engage said upper surface of said rail.

9. The shooting stand of claim 8, wherein said first, second, and third support legs each have hollow upper ends to frictionally receive leg engagement members which are attached to and extend downwardly from a bottom surface of said table.

10. The shooting stand of claim 8, said table comprising an opening for receiving a torso of a user of said stand.

* * * * *